US007415995B2

(12) United States Patent
Plummer et al.

(10) Patent No.: US 7,415,995 B2
(45) Date of Patent: Aug. 26, 2008

(54) METHOD AND SYSTEM FOR INDEPENDENTLY FILLING MULTIPLE CANISTERS FROM CASCADED STORAGE STATIONS

(75) Inventors: Darrill Lee Plummer, Midland, NC (US); Gaylord Kern Posod, Monroe, NC (US)

(73) Assignee: Scott Technologies, Boca Raton, FL (US)

( * ) Notice: Subject to any disclaimer, the term of this patent is extended or adjusted under 35 U.S.C. 154(b) by 576 days.

(21) Appl. No.: 11/201,715

(22) Filed: Aug. 11, 2005

(65) Prior Publication Data

US 2007/0034283 A1 Feb. 15, 2007

(51) Int. Cl.
*B65B 1/04* (2006.01)

(52) U.S. Cl. ..... 141/197; 141/3; 141/5; 141/83; 141/95; 141/192; 141/302

(58) Field of Classification Search ..... 141/234, 141/21, 83, 94, 95, 98, 192, 197, 236, 248, 141/285, 291, 292, 293; 62/50.1, 50.2, 50.3, 62/50.4, 50.5; 137/255, 263; 123/525, 527; 48/190–192

See application file for complete search history.

(56) References Cited

U.S. PATENT DOCUMENTS 5,107,906 A * 4/1992 Swenson et al. ..... 141/11
5,409,046 A * 4/1995 Swenson et al. ..... 141/11
5,454,408 A * 10/1995 DiBella et al. ..... 141/197
5,529,096 A 6/1996 Rowe, Jr. et al.
5,673,735 A * 10/1997 Crvelin et al. ..... 141/197
5,884,675 A * 3/1999 Krasnov ..... 141/18
6,786,245 B1 * 9/2004 Eichelberger et al. ..... 141/4

(Continued)

OTHER PUBLICATIONS

Technical Bulletin 1025, 6000 PSI Sequence Valve Models 1018 & 1085, date not provided.

(Continued)

*Primary Examiner*—George Nguyen
*Assistant Examiner*—Jason K Niesz
(74) *Attorney, Agent, or Firm*—Dean D. Small; Small Patent Law Group

(57) ABSTRACT

A canister filling system is provided for independently filling multiple canisters from a common set of storage stations prioritized in a cascaded manner. The system includes first and second fill stations configured to receive and independently fill canisters with pressurized gas. First and second storage stations store gas at corresponding first and second charge pressures, respectively. A supply-chain joins each of the first and second fill stations to both of the first and second storage stations. First and second valve assemblies are provided in the supply-chain to monitor, independent of one another, the canister pressures at the corresponding first and second fill stations. The canister pressures represent the pressure within corresponding canisters. The first and second valve assemblies automatically open and close to permit and prevent discharge of gas from the first and second storage stations, independent of one another, to automatically switch between the first and second storage stations based on the canister pressures. In one embodiment, the valve assembly includes a combination of sequence valves and check valves. Alternatively, the valve assembly may be controlled by electronic sensors and electronic solenoids. The electronic sensors detect the canister pressures and the charge pressures at the storage stations. The electronic solenoids open and close the valves based on the sensed canister pressures.

20 Claims, 4 Drawing Sheets

U.S. PATENT DOCUMENTS 6,810,925 B2 * 11/2004 Graham et al. ..... 141/98
7,128,103 B2 * 10/2006 Mitlitsky et al. ..... 141/248
7,249,617 B2 * 7/2007 Musselman et al. ..... 141/231

OTHER PUBLICATIONS

Aqua Environment Inc., Application Note 1056, date not provided.
Aqua Environment Inc., Application Note 1063, Apr. 4, 1992.

* cited by examiner

METHOD AND SYSTEM FOR INDEPENDENTLY FILLING MULTIPLE CANISTERS FROM CASCADED STORAGE STATIONS

BACKGROUND OF THE INVENTION

The invention relates generally to methods and systems for, independently and automatically, filling canisters from a common set of pressurized storage stations arranged in a priority cascaded manner.

Numerous types of canisters exist for storing pressurized gas, such as anesthesia, air, oxygen, carbon dioxide, nitrogen, compressed natural gas (CNG) and the like. One example of a canister is a self-contained breathing apparatus (SCBA) which may be used in various applications, such as by firefighters, in medical applications, in recreational underwater diving applications and the like. Various systems exist for filling the canisters with the appropriate type and amount/pressure of gas.

Heretofore, a manual filling system has been utilized in firefighting applications to refill firefighter SCBA canisters on-site at a fire, emergency or other catastrophic event. In firefighter applications, a fire truck or other vehicle carries recharging storage tanks that are arranged in different stages. The stages are prioritized, such that the primary stage is first used to fill canisters, before tapping secondary or tertiary stages. The secondary stage is used to fill canisters before the tertiary stage. The secondary and tertiary stages are only utilized when the primary stage lacks sufficient pressure to entirely fill the canister. The storage stages have separate manual control valves, outputs of which are joined to at least one fill station. Firefighters manually couple and decouple each SCBA canister to the fill station.

Typically, first and second fill stations are provided on opposite sides of the vehicle, while a third fill station is provided at the rear of the vehicle. During a fire, firefighters manually attach each canister to one of the fill stations at the vehicle containing the recharging storage tanks. Once the canister is attached to the refilling system, the firefighter determines the pressure within the canister (by reading a regulator) and based thereon, determines which of the primary, secondary and tertiary fill stages or stations should be utilized to fill a canister.

For example, a used canister may have air pressurized to less than 1000 psi, while it is desirable to fill the canister up to 4500 psi. As an example, it may be assumed that the primary storage station has air pressurized to approximately 3000 psi, while the secondary and tertiary stations have air pressurized to 4000 psi and 6000 psi, respectively. The firefighter would manually open a valve to permit the primary storage station to fill the canister to approximately 2500 psi. The firefighter would then close the valve associated with the primary storage station, and next open the valve associated with the secondary storage station. Once the canister is charged to the pressure of the primary storage station, and primary storage station valve is closed, the firefighter would then open the valve associated with the secondary storage station in order to charge the canister up to approximately 3500 psi. Once the pressure reaches approximately 3500 psi, the firefighter then closes the valve associated with the secondary storage station and opens the valve associated with the tertiary storage station in order to complete charging of the canister to the 4500 psi in the present example.

As the primary, secondary and tertiary storage stations are used, the pressure of the air contained therein falls. The primary storage station will have air pressurized to a lower level than the secondary storage station which will have air pressurized lower than the third storage station due to the practice of beginning a canister filling process from the storage station having an air pressure that is lowest of the storage stations, but greater than the initial pressure in the canister.

To perform the above process, firefighters separately couple one or more canisters to the fill stations at the rear of the vehicle and one or more canisters to each of the fill stations of either side of the vehicle. The firefighters repeat the above priority filling process for each canister. The term "priority filling" refers to the practice of prioritizing the storage stations and filling each canisters initially from a designated first or primary storage station, then from a second or secondary storage station, etc. While all of the storage stations may initially charged to a common pressure, the foregoing priority filling process causes the storage stations to differ from one another by varying degrees throughout use.

The foregoing conventional priority filling process was performed manually, in that a firefighter or a team of firefighters working in cooperation, must monitor the pressure within each canister and each storage station and manually open and close valves to utilize the storage stations in a desired priority filling sequence when filling canisters.

However, the conventional manual process has experienced several limitations. Among others, the canister filling system (such as carried by a firefighting vehicle) was typically operated by personnel who continuously attach and decouple canisters and open and close valves for the storage stations. The conventional on-site SCBA canister filling process is slow as it typically requires each a series of valves to be opened and closed manually in order to complete the fill process, which may result in firefighters waiting for new SCBA canisters to be filled without being able to assist in fighting a fire. In addition, conventional on-site SCBA canister filling stations generally involve at least one firefighter operating each of the fill stations in the priority filling order.

A need remains for an improved canister filling method and system.

BRIEF DESCRIPTION OF THE INVENTION

A canister filling system is provided for independently and automatically filling multiple canisters from a common set of storage stations arranged in a prioritized cascaded manner. The system includes at least first and second fill stations provided to receive and independently fill canisters with pressurized gas. At least first and second storage stations are configured to discharge gas at corresponding first and second charge pressures, respectively. A supply-chain independently joins each of the first and second fill stations to both of the first and second storage stations. First and second valve assemblies are provided in the supply-chain to monitor, independent of one another, the canister pressures at the corresponding first and second fill stations. The canister pressures represent the individual pressure within corresponding canisters. The first and second valve assemblies automatically open and close to permit and prevent discharge of gas from the first and second storage stations, independent of one another, to automatically prioritize and switch between the first and second storage stations based on the canister pressures.

Optionally, the valve assembly may include a combination of sequence valves and check valves. Alternatively, the valve assembly may include a control module joined to electronic sensors and an electronic actuator, such as a solenoid. The electronic sensors detect the individual canister pressures and the control module stores a predetermined pressure threshold corresponding to the charge pressures at the storage stations. The control module activates the electronic actuator to open and close the valves based on the sensed canister pressures.

In accordance with another embodiment, a method is provided for independently filling multiple canisters from a common set of cascaded storage stations. The method includes attaching canisters to first and second fill stations, where the first and second fill stations are joined along separate lines to a common set of prioritized cascaded storage stations. The cascaded storage stations include first and second storage stations configured to discharge gas at select different first and second charge pressures. The method further includes monitoring the canister pressure at each of the individual canisters at the first and second fill stations, independent of one another, and separately comparing the canister pressure from each of the canisters to the first and second charge pressures. The method further includes automatically opening and closing valves to permit and prevent discharge of gas from the first and second storage stations to the first and second fill stations, thereby prioritizing and switching between the first and second storage stations based on the corresponding canister pressures.

Optionally, the method may further include removing a canister from the first fill station while the canister at the second fill station is continuing to be filled. The canisters may be filled at the first and second fill stations at different flow rates or within different first and second time intervals. The canisters at the first and second fill stations may also be different in size or have different volumes to be filled. Each individual canister is progressively filled to low pressure, then medium pressure and then high pressure while coupled to a single fill station throughout the complete progressive filling process.

DETAILED DESCRIPTION OF THE INVENTION

Figure 1:
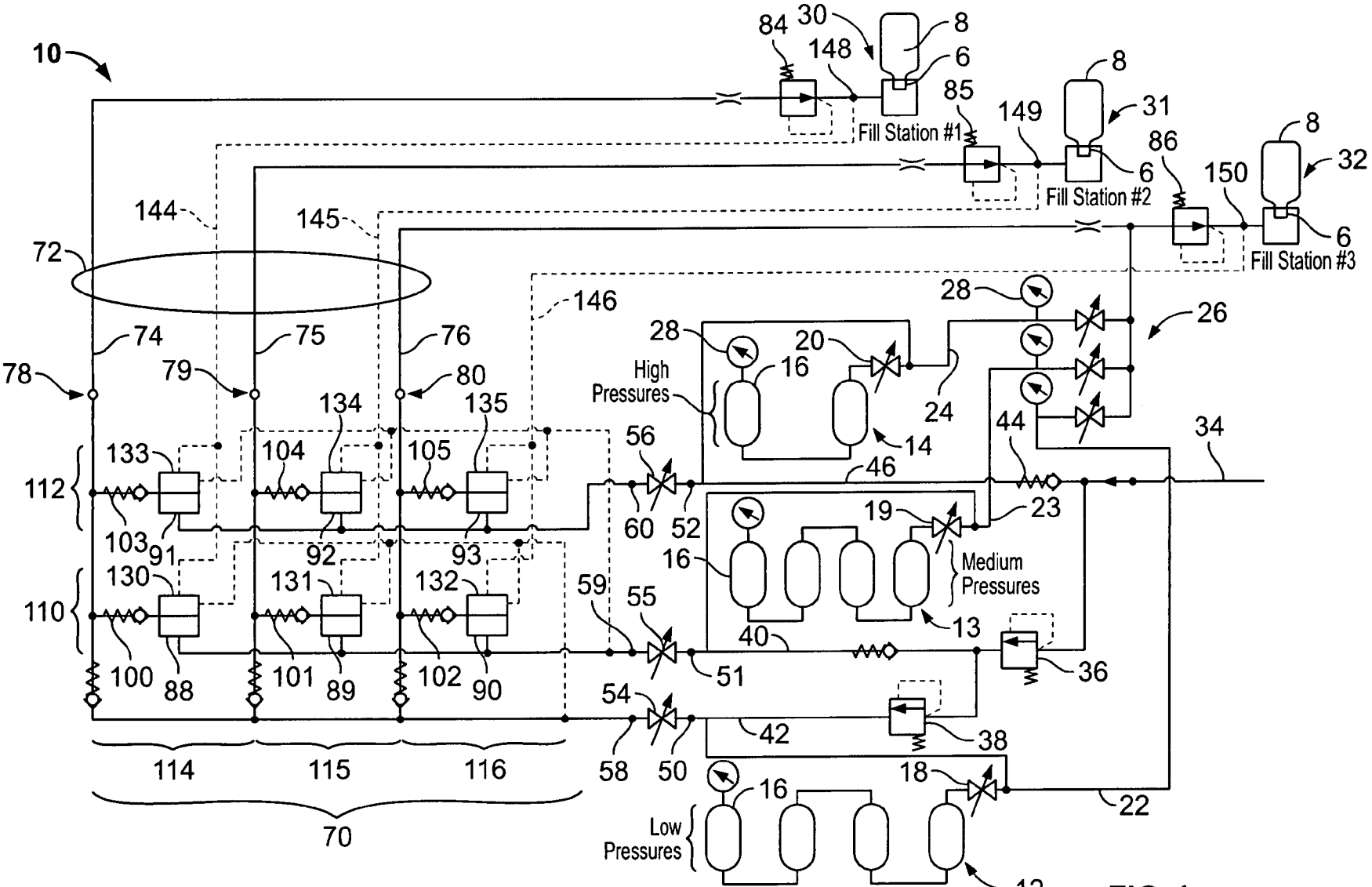
FIG. 1 illustrates a flow diagram of a canister filling system provided in accordance with an embodiment of the present invention.

FIG. 1 illustrates a flow diagram of a canister filling system 10 that is provided in accordance with an embodiment of the present invention. By way of example, canisters 8 may represent SCBA canisters utilized by firefighters. The canisters 8 are attached and decoupled to/from fill stations 30-32 by couplings 6 before and after a complete filling operation. The system 10 includes fill stations 30-32 that are independently attached to a common set of prioritized storage stations, namely a first or primary pressure storage station 12, a second or secondary storage station 13 and a third or tertiary pressure storage station 14. The fill stations 30-32 are configured to receive and independently fill canister 8 with pressurized gas (e.g. anesthesia, oxygen, air, CNG, nitrogen, carbon dioxide and the like). The storage stations 12-14 are joined in a prioritized cascaded manner and configured to discharge gas at corresponding charge pressures.

The storage stations 12-14 may initially store gas at the same pressure, but due to the priority filling process, as the storage stations 12-14 are used to deliver gas into canisters 8, the pressures in storage stations 12-14 change. The gas is dispensed in a priority manner, such that gas is first dispensed from the storage station 12, then from the storage station 13, then from the storage station 14. In the present example, the storage station 12 is the primary stage and thus is first used to fill canisters 8. The secondary storage station 13 is only used when the pressure within the primary storage station 12 is less than the maximum desired pressure to which canisters 8 are to be filled. Similarly, the tertiary storage station 14 is only used when the pressure within the secondary storage station 13 is less than the maximum desired pressure.

Each of the storage stations 12-14 comprises one or more storage tanks or bottles 16 joined in series with one another. Optionally, a compressor may be attached to or, provided at, one or more of the storage stations 12-14. Inlets to the storage stations 12-14 are provided with manual shutoff valves 18-20 that are attached through lines 22-24 to a panel 26 of manual shutoff valves. The panel 26 of manual valves enables manual control of at least one fill station (e.g. fill station 32).

Pressure gauges 28 are provided throughout the system 10 to facilitate pressure monitoring. An input line 34 (from a remote source or compressor) is attached through valves 36 and 38 and lines 40 and 42 to the storage stations 13 and 12, respectively. The input line 34 is attached to the high-pressure storage station 14 through a check valve 44 and line 46. The valves 36 and 38 include back pressure regulators that prevent gas from flowing there through unless a pressure threshold defined by the valve setting is reached at the inlets to the valves 36 and 38. The values 36 and 38 facilitate priority filling of the bottles 16, starting at the storage station 14, then storage station 13 and then storage station 12. Optionally, more than three or fewer than three storage stations and different change pressures may be utilized.

The storage stations 12-14 have discharge ports 50-52 that communicate with manual shutoff valves 54-56, that attach to inlet ports 58-60 of a valve assembly 70. The valve assembly 70 is provided in a supply-chain 72 comprised of parallel supply lines 74-76 that are joined to outlet ports 78-80 of the valve assembly 70. The supply-chain 72 joins each of the fill stations 30-32 to the common set of storage stations 12-14. The supply lines 74-76 extend to fill stations 30-32, respectively. Optionally, more than three or fewer than three fill stations 30-32 and corresponding supply lines 74-76 may be utilized. Regulators 84-86 are provided in the supply lines 74-76 proximate the fill stations 30-32 to enable operators to open and close each of the supply lines 74-76 independently when attaching and decoupling canisters to each of the corresponding fill stations 30-32.

The fill stations 30-32 are configured to receive and independently fill canisters 8 with pressurized gas (e.g. anesthesia, oxygen, air, CNG, nitrogen, carbon dioxide and the like). The storage stations 12-14 are joined in a cascaded manner and configured to discharge gas at corresponding charge pressures (which changes with use).

The valve assembly 70 is provided in the supply-chain 72 and is attached to each fill station 30-32 in order to monitor each of the fill stations 30-32, independent of one another. The valve assembly 70 independently monitors the canister pressure at each canisters 8 at each of the fill stations 30-32, where the canister pressure represents the individual pressure within the corresponding canister 8 being filled. The valve assembly 70 automatically opens and closes to permit and prevent the discharge of gas from the storage stations 12-14 independently for each of the supply lines 74-76, in order to prioritize and automatically switch between the storage stations 12-14 based on individual canister pressures. The valve assembly 70 compares the charge pressure at each of the storage stations 12-14 to the corresponding canister pressure and based thereon, performs the independent and automatic switching operation.

The valve assembly 70 includes a series of valves 88-93 conceptually arranged, for ease of explanation, in rows 110, 112 and columns 114-116. Each conceptual row 110, 112 is associated with a particular storage station, for example storage stations 13 and 14, respectively. Each conceptual column 114-116 is associated with a particular fill station, for example fill stations 30-32, respectively. Each column 114-116 defines a fill station valve sub-assembly, while each row 110 and 112 defines a storage pressure stage associated with one pressure level or range.

Figure 2:
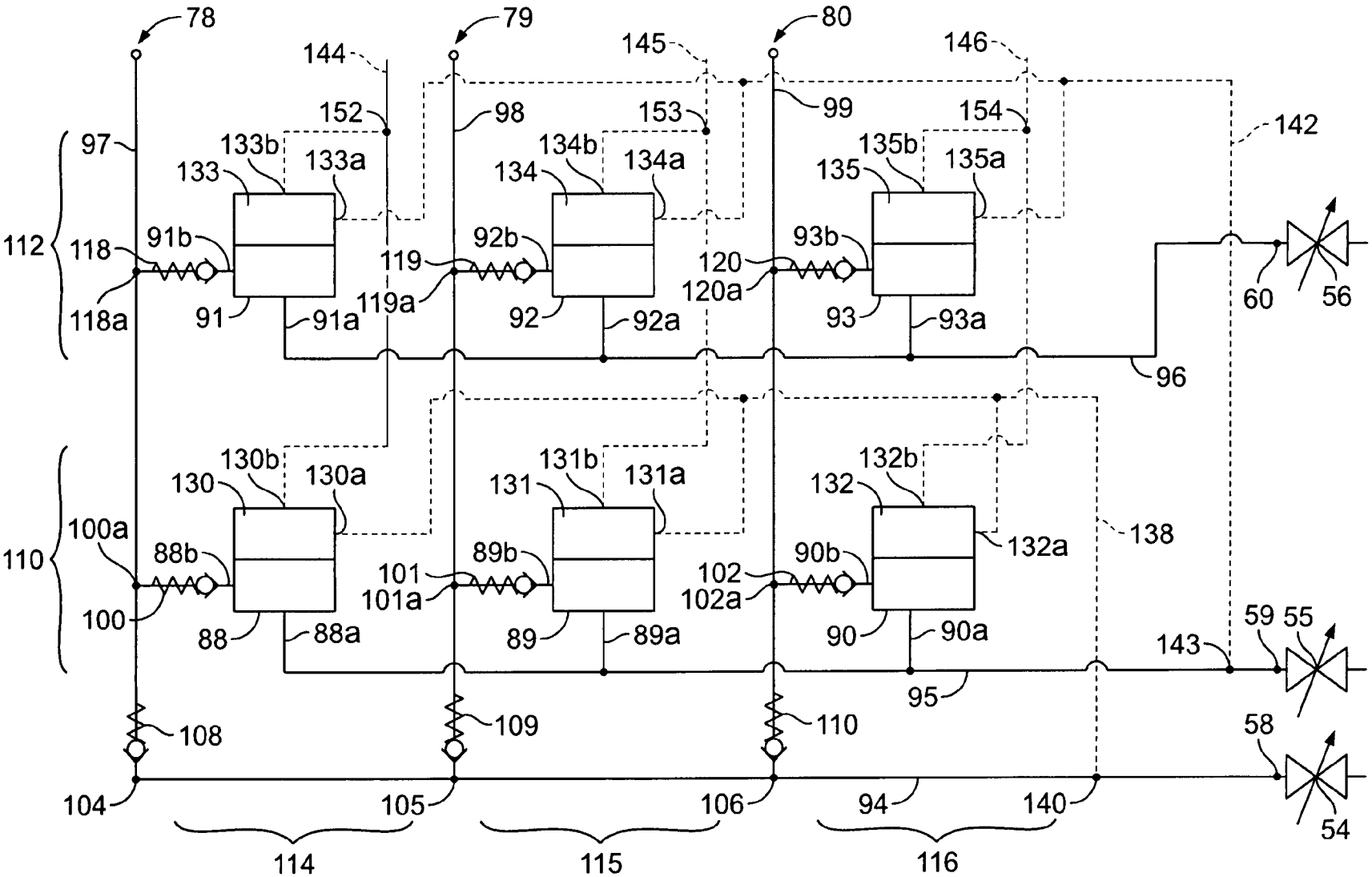
FIG. 2 illustrates the valve assembly of FIG. 1 in more detail.

FIG. 2 illustrates the valve assembly 70 of FIG. 1 in more detail. The valve assembly 70 includes inlet ports 58-60 that may be joined to manual shutoff valves 54-56. The inlet ports 58-60 are configured to be joined to the cascaded storage stations 12-14 (FIG. 1). The inlet ports 58-60 supply pressurized gas over primary, secondary and tertiary lines 94-96. The valve assembly 70 further includes priority discharge lines 97-99 that are joined to outlet or discharge ports 78-80 that are configured to be joined to, and independently supply gas to, fill stations 30-32 (FIG. 1). When all three storage stations 12-14 are used, the gas pressure provided over the priority discharge lines 97-99 will automatically vary between the pressures within storage stations 12-14 (e.g., from a low-pressure, to a median pressure and then to a high-pressure) as the canisters 8 at each corresponding fill station 30-32 is filled.

The line 94 is joined at nodes 104-106 through check valves 108-110, respectively, to the priority discharge lines 97-99. The check valves 108-110 open and close based upon the pressure differential there across, such that each check valves 108-110 closes when the pressure on the priority discharge line 97-99, respectively, becomes substantially equal to or greater than the pressure within the line 94. The check valves 108-110 open and close independent of one another. For example, check valve 108 may be closed (such as when an empty or near empty canister is attached to fill station 30), check valve 109 may be open (such as when no canister is attached to fill station 31), and check valve 110 may be closed (such as when a canister is partially filled to a canister pressure substantially equal to or greater than the pressure in the line 94).

The valves 88-93 have gas inlets 88*a*-93*a* and gas outlets 88*b*-93*b*. The valves 88-93 open and close to permit or to prevent gas flow through the valves 88-93 from the gas inlets 88*a*-93*a* to the corresponding gas outlets 88*b*-93*b*. The gas inlets 88*a*-90*a* are joined to the line 95, while gas inlets 91*a*-93*a* are joined to the line 96. The gas outlets 88*b*-90*b* are attached to check valves 100-102 that, in turn, are joined at nodes 100*a*-102*a* to the priority discharge lines 97-99, respectively. The check valves 100-102 open when the pressures at gas outlets 88*b*-90*b* exceed the pressures at nodes 100*a*-102*a*, respectively, and close when the pressures at gas outlets 88*b*-90*b* are below the pressures at nodes 100*a*-102*a*, respectively. The check valves 100-102 operate independent of one another. For example, check valve 100 may be open, while check valves 101 and 102 are closed.

The gas outlets 91*b*-93*b* are attached to check valves 118-120 that, in turn, are joined at nodes 118*a*-120*a* to the priority discharge lines 97-99, respectively. The check valves 118-120 open when the pressures at gas outlets 91*b*-93*b* exceed the pressures at nodes 118*a*-120*a*, respectively, and close when the pressures at gas outlets 91*b*-93*b* are below the pressures at nodes 118*a*-120*a*, respectively. The check valves 118-120 operate independent of one another. For example, check valve 120 may be open, while check valves 118 and 119 are closed.

The valves 88-93 are joined to, and controlled by, sensor units 130135. By way of example, the combination of a valve and associated sensor unit may be implemented in a sequence valve (e.g., sequence valve models 1018 or 1085 by Aqua Environment, Inc., of Stinson Beach, Calif.). For example, valve 88 and sensor unit 130 may constitute a single sequence valve. The sensor units 130-135 have control pressure ports 130*a*-135*a* and 130*b*-135*b*. The control pressure ports 130*a*-132*a* are joined to a common primary source pressure sensor line 138 which, in turn, is joined at node 140 to the line 94. The pressure sensor line 138 communicates the pressure within the line 94 to each of sensor units 130-132. The control pressure ports 133*a*-135*a* are joined to a common secondary source pressure sensor line 142 which, in turn, is joined at node 143 to the pressure line 95. The pressure sensor line 142 communicates the pressure within the pressure line 95 to each of sensors 133-135. The control pressure ports 130*b*-132*b* are joined to canister pressure sensor lines 144146. The control pressure ports 133*b*-135*b* are also joined to the canister pressure sensor lines 144-146 at nodes 150-154, respectively. As shown in FIG. 1, the canister pressure sensor lines 144-146 are joined at nodes 148-150 to the fill stations 30-32, respectively, in order to monitor independently the canister pressure of each canisters 8 being filled at each fill station 30-32.

Returning to FIG. 2, the sensor units 130-135 open and close corresponding valves 88-93 based upon the pressure differential between corresponding control pressure ports 130*a*-135*a* and 130*b*-135*b*. For example, the sensor units 130-135 may remain closed until the pressures at the corresponding control pressure ports 130*a*-135*a* and 130*b*-135*b* fall within a predefined pressure differential threshold. For example, sensor unit 130 may remain closed until the pressure at control pressure port 130*b* rises to within 250 psi of the pressure at control pressure port 130*a*. Once the pressure differential between control pressure ports 130*a* and 130*b* falls within the predefined pressure differential threshold (e.g. 250 psi), the sensor unit 130 acts upon the valve 88 to cause the valve 88 to open. Sensor units 131-135 operate in the same manner as sensor 130 but independent of one another.

Next, an exemplary filling operation will be described. Once a canister 8 is attached at coupling 6 to fill station 30, regulator 84 is opened. The initial canister pressure in the canister 8 at fill station 30 may be below the pressure within the line 94. Thus, check valve 108 (FIG. 2) opens to begin filling the canister 8 from the low-pressure storage station 12. The sensor unit 130 continuously compares the canister pressure with the pressure within the line 94. The canister pressure is provided over canister pressure sensor line 144 to control pressure port 130*b*, while the pressure within the line 94 is provided over the pressure sensor line 138 to the control pressure port 130*a*. When the canister pressure rises to within the predefined pressure differential of the pressure within the line 94, the sensor unit 130 directs the valve 88 to open.

When the valve 88 opens, the gas within the secondary pressure line 95 is delivered through the valve 88 to port 88*b*. The check valve 100 opens to deliver gas into the priority discharge line 97 at node 100*a*. Once the valve 88 and check valve 100 open, the pressure within the priority discharge line 97 rises to approach the pressure within line 95 which exceeds the pressure within the line 94. The check valve 108 closes when the pressure within priority discharge line 97 exceeds the pressure within line 94. The canister 8 continues to fill with gas until the canister pressure approaches the pressure within the line 95. The sensor unit 133 continuously compares the canister pressure with the pressure within the line 95. The canister pressure is provided over canister pressure sensor line 144 through node 152 to control pressure port 133*b*, while the pressure within the line 95 is provided over the pressure sensor line 142 to the control pressure port 133*a*. When the canister pressure rises to within the predefined pressure differential of the pressure within the line 95, the sensor unit 133 directs the valve 91 to open.

When the valve 91 opens, the gas within the tertiary pressure line 96 is delivered through the valve 91 and check valve 118 into the priority discharge line 97 at node 118*a*. Once the valve 91 and check valve 118 open, the pressure within the priority discharge line 97 rises to approach the pressure within line 96 which exceeds the pressure within the line 95. The check valve 100 closes when the pressure within priority discharge line 97 exceeds the pressure within line 95. The valve 88 may remain open as the check valve 100 is closed, thereby preventing the gas within the priority discharge line 97 from bleeding back into the line 95. The canister 8 continues to fill with gas until the canister pressure approaches the pressure within the line 96 and the canister 8 reaches a desired high pressure level. In the foregoing manner, the valves 88 and 91, sensor units 130 and 133, and check valves 108, 100 and 118 in column 114 cooperate to define a first fill station valve sub-assembly that fills a canister 8 at fill station 30 in a priority cascaded manner by automatically moving from line 94 to line 95 to line 96 (e.g., effectively moving from low-pressure gas, to medium pressure gas and to high pressure gas).

The valves 89 and 92, sensor units 131 and 134 and check valves 109, 101 and 119 located within the column 115 cooperate to define a second fill station valve sub-assembly that operates independent of, but in the same manner as, the fill station valve sub-assembly in column 114 (e.g., valves 88 and 91, sensor units 130 and 133, and check valves 108, 100 and 118). More specifically, when an empty or low canister 8 is provided at fill station 31, valves 89 and 92 are initially closed. Check valve 109 opens to permit gas from the line 94 to supply the discharge line 79. When the canister pressure approaches the pressure within the line 94, sensor unit 131 directs the valve 89 to open, after which check valve 101 opens and check valve 109 closes. When the canister pressure approaches the pressure within the line 95, sensor unit 134 directs the valve 92 to open, after which check valve 119 opens and check valve 101 closes. The valves 89 and 92, sensor units 131 and 134 and check valves 109, 101 and 119 located within the column 115 cooperate to priority fill a canister at fill station 31 in a cascaded manner by automatically moving from low-pressure gas, to medium pressure gas and to high pressure gas.

The valves 90 and 93, sensor units 132 and 135 and check valves 110, 102 and 120 located within the column 116 define a third fill station valve sub-assembly that operates independent of, but in the same manner as, the first and second fill station valve sub-assemblies in columns 114 and 115. The valves 90 and 93, sensor units 132 and 135 and check valves 110, 102 and 120 located within the column 116 cooperate to priority fill a canister 8 at fill station 32 in a cascaded manner by automatically moving from low-pressure gas, to medium pressure gas and to high pressure gas.

Optionally, one or more of the columns 114-116 may be modified to have a different number of pressure levels as compared to the other columns 114-116. For example, the valve 91, sensor unit 133 and check valve 118 may be removed from the fill station valve sub-assembly of column 114, such that the discharge line 97 only supplies primary and secondary gas to station 30, and does not offer the ability to provide gas from station 14. Alternatively, additional stages may be added to one or more of the fill station sub-assemblies in columns 114-116 by simply adding additional rows of valves, sensor units and check valves similar to either of rows 110 and 112. Optionally, the sensor units 130-135 may utilize different pressure differentials. For example, the sensor units 130-132 in stage or row 110 may utilize a pressure differential of 250 psi, while the sensor units 133-135 in stage or row 112 utilize a pressure differential of 500 psi. Optionally, each individual sensor unit 130135 may have a distinct and different pressure differential.

The canisters 8 are independently attached to, and decoupled from, the fill stations 30-32. The canisters may be filled at different rates, such as through adjustment of regulators 84-86. The canisters 8 may have different sizes/volumes to be filled simultaneously, and may be filled to different pressure levels. Each individual canister is automatically progressively filled from prioritized storage stages or stations.

Figure 3:
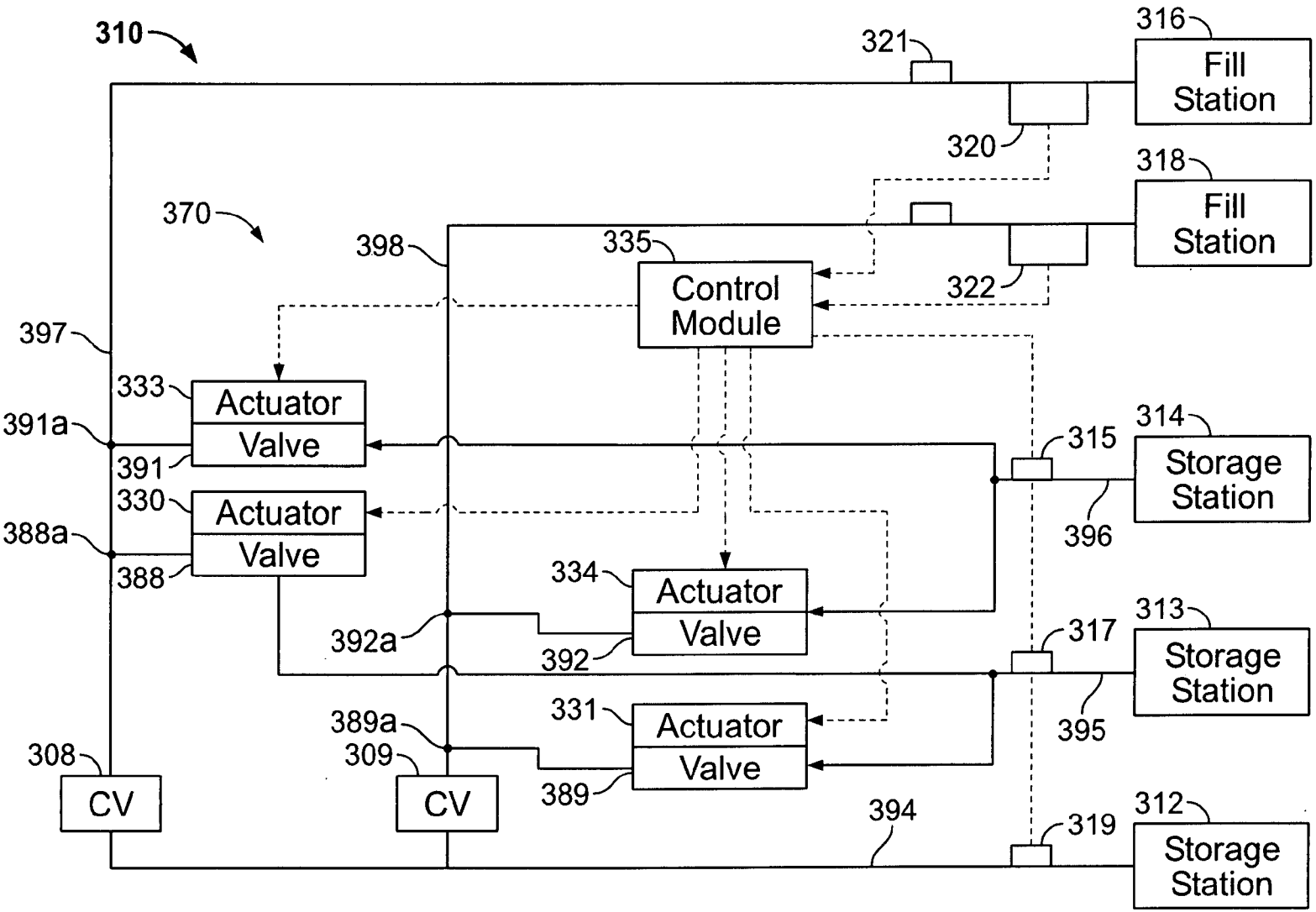
FIG. 3 illustrates a flow diagram of a canister filling system provided in accordance with an alternative embodiment of the present invention.

FIG. 3 illustrates a flow diagram of a canister filling system 310 provided in accordance with an alternative embodiment of the present invention. The system 310 includes storage stations 312-314. The storage stations 312-314 are attached through valve assembly 370 to fill stations 316 and 318. The storage station 312 represents a primary gas supply over line 394 which is coupled through check valves 308 and 309 to discharge lines 397 and 398. The storage station 313 provides a secondary gas supply over line 395 to valves 388 and 389. Valves 388 and 389 are coupled to the discharge lines 397 and 398 directly at nodes 388*a* and 389*a* (without intervening check valves). The storage station 314 provides a tertiary gas supply over line 396 to valves 391 and 392. Valves 391 and 392 are coupled to the discharge lines 397 and 398 directly at nodes 391*a* and 392*a*.

The valves 388-392 are controlled by actuators 330-334, respectively. By way of example, the actuators 330-334 may represent electronically controlled solenoids that drive the valves 388-392 between open and closed positions. The actuators 330-334 are controlled by control module 335. By way of example, control module 335 may convey electrical current to actuators 330-334 that moves solenoids between first and second states, corresponding to open and closed positions of the valves 388-392. The control module 335 monitors the canister pressure at fill stations 316 and 318 through sensors 320 and 322. The sensors 320 and 322 may be pressure transducers and the like that detect a pressure at the fill stations 316 and 318, respectively. The sensors 320 and 322 convey electrical signals to the control module 335 indicative of the canister pressure. The control module 335 monitors the pressure at stations 312-314 through sensors 315, 317 and 319. The control module 335 may continuously compare the pressure signals sent from sensors 320 and 322 with the pressure thresholds signals from sensors 315, 317 and 319, and based thereon drive the actuators 330-334 between open and closed states.

Next, the operation of the valve assembly 370 will be described in connection with an example. When a canister is attached to fill station 316, the control module 335 determines that the canister pressure low and directs actuators 330-334 to maintain valves 388-392 closed. Check valve 308 permits gas from the line 394 to begin filling the canister at fill station 316 once the valve or regulator 321 is opened. When the canister pressure approaches the pressure of storage station 312, the control module 335 directs the actuator 330 to open valve 388 which, in turn, supplies gas from the line 395 to the discharge line 397. Check valve 308 closes. When the canister pressure reaches the pressure threshold of storage station 313, if not full, the control module 335 directs actuators 330 to close valve 388 and directs actuators 333 to open valve 391 which, in turn, supplies gas from the line 396 to the discharge line 397. Check valves may not be provided between the discharge line 397 and valves 388 or 391 when the control module 335 is configured to instruct the actuators 330-334 to close the valves 388-392. Optionally, the control module 335 may determine, when the canister reaches the full pressure level, that the canister is full and instruct actuator 333 to close valve 391.

The control module 335 similarly monitors the canister pressure at fill station 318 to direct operation of actuators 331 and 334 in connection with control of valves 389 and 392.

Optionally, the control module 335 may be replaced by locating separate and independent controllers at each of the actuators 330-334. The control module 335 and actuators 330-334 may be electrically controlled, hydraulically controlled, pneumatically controlled and the like. Optionally, the actuators 330-334 may not mechanically drive the valves 388-391, but instead may hydraulically or pneumatically drive the valves 388-391 between open and closed positions.

Figure 4:
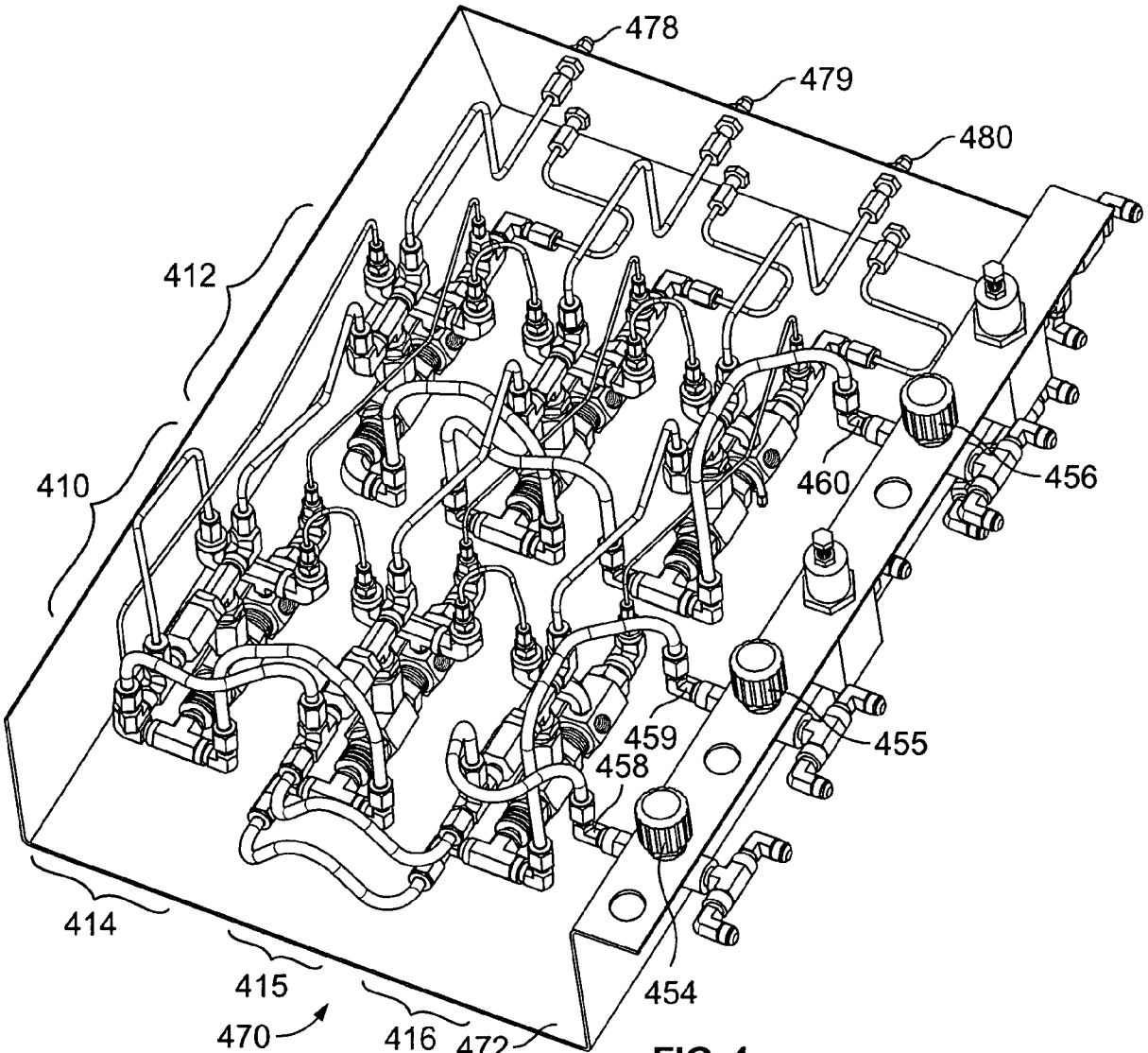
FIG. 4 illustrates a top isometric view of a retrofit valve assembly provided in accordance with an embodiment of the present invention.

FIG. 4 illustrates a top isometric view of a valve assembly 470 provided in accordance with an embodiment of the present invention. The valve assembly 470 may be housed within a self-contained housing 472, such as for installation in new systems are or a retrofit upgrade to pre-existing filling systems. For example, the valve assembly 470 may be retrofitted into an existing fire truck or other emergency vehicle that contains storage tanks pressurized to different cascaded pressure levels. The housing 472 securely retains manual shutoff valves 454-456 that are joined to inlet reports 458-460. The housing 472 also securely retains discharge ports 478-480. The valve assembly 470 is arranged in rows 410, 412 representing storage pressure stages and columns 414-416 representing fill station assemblies. The valve assembly 470 operates in the manner described above in connection with FIGS. 1 and 2.

The term "gas" as used throughout is intended to refer to any compressible, non-liquid medium. The term "pressure" as used throughout is not limited to a single discrete level or value, but instead is intended to refer to a pressure range.

While the invention has been described in terms of various specific embodiments, those skilled in the art will recognize that the invention can be practiced with modification within the spirit and scope of the claims.

What is claimed is:

1. A canister filling system, comprising:

first and second fill stations configured to receive and independently fill canisters with pressurized gas;

first and second storage stations storing gas at corresponding first and second charge pressures, respectively, the first and second storage stations being prioritized in a cascaded manner;

a supply-chain independently joining each of the first and second fill stations to both of the first and second storage stations; and first and second valve sub-assemblies provided in the supply-chain, the first and second valve sub-assemblies monitoring, independent of one another, canister pressures at the corresponding first and second fill stations, the canister pressure representing a pressure within a corresponding canister, the first and second valve sub assemblies automatically opening and closing to permit and prevent discharge of gas from the first and second storage stations, independent of one another, to automatically switch between the first and second storage stations based on the priority and the canister pressures.

2. The canister filling system of claim 1, wherein each of the first and second valve sub-assemblies compares the first charge pressure and the corresponding canister pressure and based thereon performs the independent and automatic switching.

3. The canister filling system of claim 1, wherein each of the first and second valve sub-assemblies includes first and second valves located in the supply-chain between the corresponding fill station and of the first and second charge stations, respectively.

4. The canister filling system of claim 1, wherein each of the first and second valve sub-assemblies automatically opens the first storage station and automatically closes the second storage station when the corresponding canister pressure is below the first charge pressure.

5. The canister filling system of claim 1, further comprising a third storage station configured to discharge gas at a third charge pressure, each of the first and second valve sub-assemblies maintaining the third storage station closed until the corresponding canister pressure rises to within a predefined range of the third charge pressure.

6. The canister filling system of claim 1, wherein the canisters represent self contained breathing apparatus for use by fire fighters.

7. The canister filling system of claim 1, further comprising first and second fill station sensor lines attached to, and interconnecting, the first and second fill stations and the first and second valve sub-assemblies, respectively, and first and second storage station sensor lines attached to, and interconnecting, the first and second storage stations and the first and second valve sub-assemblies, respectively.

8. The canister filling system of claim 1, wherein the first and second valve sub-assemblies further comprise first and second sequence valves and check valves joined to one another and to the first and second fill stations, respectively.

9. A valve assembly for independently and automatically filling canisters from a common set of cascade storage stations, the valve assembly comprising:

first and second discharge ports configured to be joined to, and independently supply gas to, first and second fill stations to fill canisters with pressurized gas;

first and second inlet ports configured to be joined to prioritized first and second storage stations storing pressurized gas at corresponding first and second charge pressures, respectively; and a valve assembly provided between the first and second inlet and outlet ports, respectively, the valve assembly monitoring individual canister pressures at the corresponding first and second fill stations, the canister pressures representing a pressure within a corresponding individual canister, the valve assembly automatically opening and closing to permit and prevent discharge of gas from the first and second outlet ports, independent of one another, to automatically switch between the first and second storage stations based on the priority and the individual canister pressures.

10. The valve assembly of claim 9, wherein the valve assembly is organized into first and second fill station valve sub-assemblies that independently priority fill canisters at the first and second fill stations by automatically moving from the first and second storage station.

11. The valve assembly of claim 9, wherein the valve assembly includes first and second valve sub-assemblies that each includes first and second valves located between the corresponding first and second inlet and outlet ports, respectively.

12. The valve assembly of claim 9, wherein the valve assembly includes first and second valve sub-assemblies that each automatically permits gas to discharge from the first storage station and automatically prevents gas to discharge from the second storage station when the corresponding canister pressure is below the first charge pressure.

13. A method of independently filling multiple canisters from a common set of cascade storage stations, the method comprising:

attaching canisters to first and second fill stations, the first and second fill stations being joined along separate lines to a common set of prioritized storage stations, the storage stations including first and second storage stations storing gas at corresponding first and second charge pressures;

separately monitoring a canister pressure at each of the individual canisters at the first and second fill stations;

individually comparing the canister pressures from each of the canisters to the first and second charge pressures;

automatically opening and closing discharge of gas from the first and second storage stations to the first fill station to automatically switch between the first and second storage stations based on the priority and the corresponding canister pressure; and automatically opening and closing discharge of gas from the first and second storage stations to the second fill station, independent from the first fill station, to automatically switch between the first and second storage stations based on the priority and the corresponding canister pressure.

14. The method of claim 13, wherein each individual canister is progressively filled to low pressure, then medium pressure and then high pressure while coupled to a single fill station throughout the complete progressive filling process.

15. The method of claim 13, further comprising removing the canister from the first fill station while the canister at the second fill station is being filled.

16. The method of claim 13, wherein the automatically opening and closing includes filling the canister in the first fill station from the first storage station while simultaneously filling the canister in the second fill station from the second storage station.

17. The method of claim 13, further comprising replacing the canister at the first fill station while the canister at the second fill station is being filled, the filling method being performed at a fire while fire fighters are fighting the fire.

18. The method of claim 13, further comprising maintaining at least one of the canisters attached to the first fill station throughout a complete filling process from a low pressure to a high pressure.

19. The method of claim 13, wherein the canisters at the first and second fill stations have different volumes.

20. The method of claim 13, further comprising completing a filling operation of the canisters at the first and second fill stations at one of different first and second time intervals and different first and second flow rates.

* * * * *